US006272694B1

(12) United States Patent
Weaver et al.

(10) Patent No.: US 6,272,694 B1
(45) Date of Patent: Aug. 14, 2001

(54) ENHANCED INTERFACE FOR ELECTROSTATIC DISCHARGE GARMENT

(75) Inventors: Ron L. Weaver, Paso Los Cerritos; R. Bruce Prime; Gary W. Knoth, both of San Jose, all of CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/401,971

(22) Filed: Sep. 24, 1999

(51) Int. Cl.[7] ..... H05F 3/02; A41D 13/02
(52) U.S. Cl. ..... 2/456; 2/69; 361/220
(58) Field of Search ..... 2/275, 455, 456, 2/69, 1; 361/212, 220; 57/901

(56) References Cited

U.S. PATENT DOCUMENTS

| | | | | |
|---|---|---|---|---|
| 4,546,497 | | 10/1985 | Ono et al. . | |
| 4,836,796 | | 6/1989 | Burvee . | |
| 4,868,710 | * | 9/1989 | Powell | 2/69 X |
| 4,932,078 | | 6/1990 | Jones et al. . | |
| 5,004,425 | | 4/1991 | Hee . | |
| 5,073,984 | * | 12/1991 | Tone et al. | 2/2 |
| 5,491,022 | | 2/1996 | Smith . | |
| 5,715,536 | | 2/1998 | Banks . | |
| 5,736,469 | | 4/1998 | Bhattacharjee et al. . | |
| 6,079,343 | * | 6/2000 | Wong | 2/275 X |

* cited by examiner

*Primary Examiner*—Peter Nerbun
(74) *Attorney, Agent, or Firm*—Robert B. Martin; Bracewell & Patterson, L.L.P.

(57) ABSTRACT

An electrostatic discharge garment is formed from material having a grid of conductors for conducting static electricity. The conductors are overlapped at the seams of the garment and interconnected with conductive flat ribbons that extend throughout the garment. The garment also has external grounding fasteners which are joined to the grid and ribbons. A hole is formed in the garment at the site of each fastener. Each hole extends through the fabric, grid, and ribbons. An epoxy applicator injects a small amount of conductive epoxy adjacent to the hole and saturates the various elements. The fastener is then installed while the epoxy is still wet. After the epoxy cures, a flexible but resilient joint is formed between it, the fastener, the grid, and the ribbon.

5 Claims, 2 Drawing Sheets

ENHANCED INTERFACE FOR ELECTROSTATIC DISCHARGE GARMENT

BACKGROUND OF THE INVENTION

1. Technical Field

This invention relates in general to garments that discharge static electricity and in particular to an apparatus and method for enhancing the interfaces at the fasteners and seams of electrostatic discharge garments.

2. Background Art

Garments for discharging static electricity are well known in the art. These garments usually are worn by personnel involved in manufacturing electrically sensitive products. The garments are typically formed from a material having a grid of electrically conductive fibers or ribbons. The fibers are very small so as to allow the electrostatic discharge (ESD) garment to retain the flexibility of garments formed from conventional fabrics. Unfortunately, the frail fibers are easily broken after being washed just a few times, thereby quickly rendering the garment unreliable. This makes the garments more expensive on a cost per use basis. Studies have shown that most fiber breakages occur at the seams of the garments and at the fastener interfaces. Thus, a more reliable ESD garment with durable fiber joints is needed.

SUMMARY OF THE INVENTION

An electrostatic discharge garment is formed from material having a grid of conductors for conducting static electricity. The conductors are overlapped at the seams of the garment and interconnected with conductive flat ribbons that extend throughout the garment. The garment also has external grounding fasteners which are joined to the grid and ribbons.

A hole is formed in the garment at the site of each fastener. Each hole extends through the fabric, grid, and ribbons. An epoxy applicator injects a small amount of conductive epoxy adjacent to the hole and saturates the various elements. The fastener is then installed while the epoxy is still wet. After the epoxy cures, a flexible but resilient joint is formed between it, the fastener, the grid, and the ribbon.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

BEST MODE FOR CARRYING OUT THE INVENTION

Figure 1:
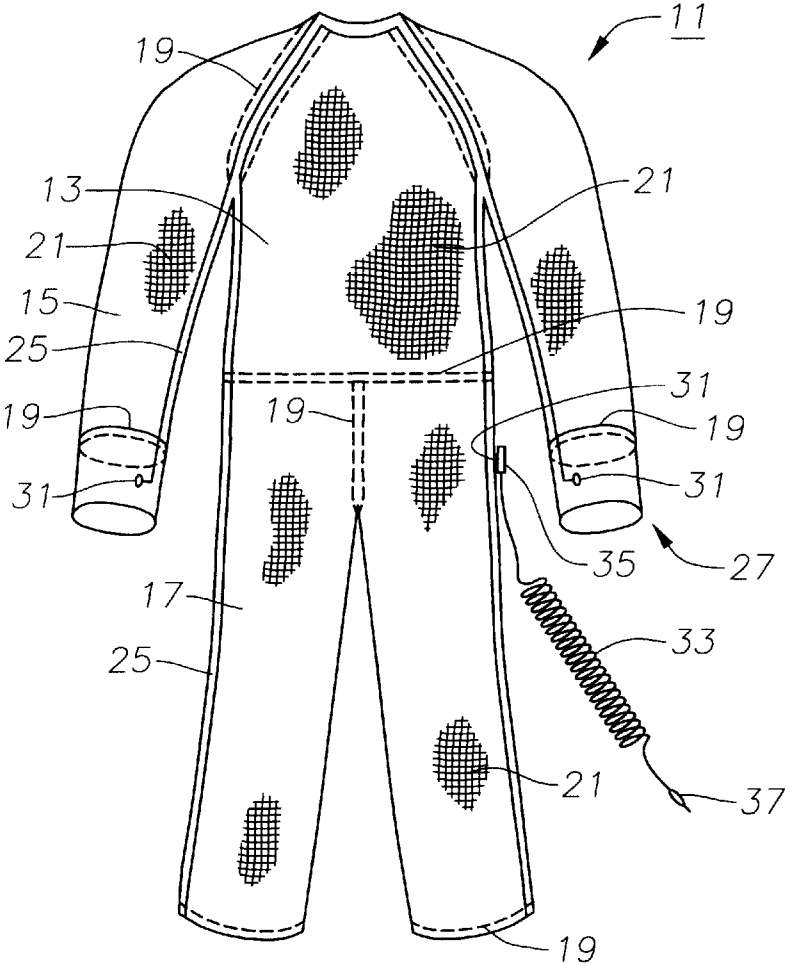
FIG. 1 is a front view of an exemplary ESD garment.

Referring to FIG. 1, an electrostatic discharge garment 11 is shown. Garment 11 has an abdominal portion 13, arm portions 15, and leg portions 17 all of which are sewn or otherwise joined together by a plurality of seams 19. Although garment 11 is shown as a full body suit, it should be apparent that it may be formed in many different patterns and applications.

Figure 2:
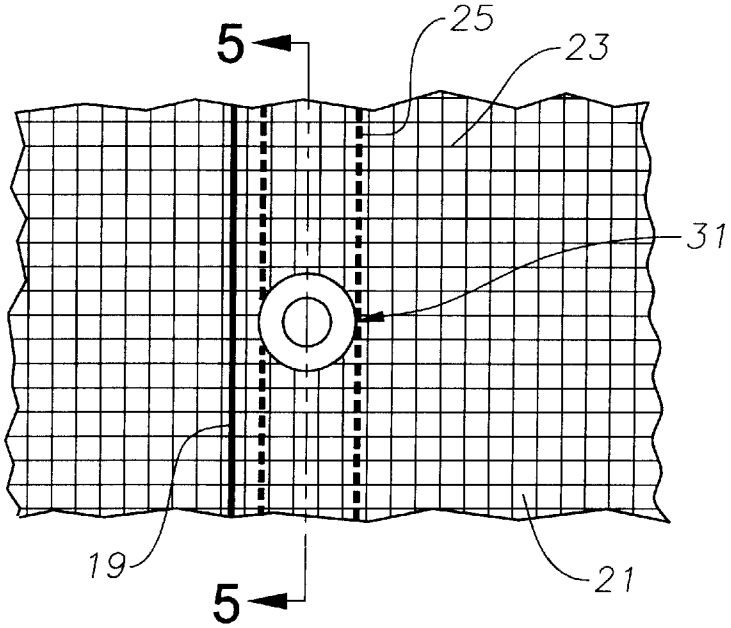
FIG. 2 is an enlarged front view of fastener portion of the garment of FIG. 1.

Garment 11 is formed from a thin, lightweight fabric material having a continuous grid 21 of conductors 23 (FIG. 2) for conducting static electricity. The conductors 23 are overlapped at the seams 19 so that a continuous circuit is formed between all portions 13, 15, 17, 19 of garment 11. Garment 11 also has electrically conductive flat ribbons 25 that extend throughout its portions 13, 15, 17, 19. Ribbons 25 are overlapped and sewn at seams 19 so that a continuous electrical circuit is established along their lengths and with the various grids 21. Note that the arm portions 15 have conductive knit cuffs 27 on their distal ends which contact the skin of the user. Cuffs 27 are interconnected to their adjacent grids 21 and ribbons 25.

Garment 11 is provided with a plurality of fasteners 31 (FIGS. 1 and 2) which are located at various positions on the exterior of garment 11. In the embodiment shown, garment 11 has a fastener 31 near the upper end of one leg portion 17 and near the distal end of each arm portion 15. Each fastener 31 is in electrical contact with its adjacent grids 21 and ribbons 25. Fasteners 31 are provided for grounding garment 11 via a cord 33 with connectors 35, 37, and may take many different forms depending on the type of connector it needs to attach to. Connector 35 (FIG. 1) is shown snapped or otherwise attached to one of fasteners 31. Any static electricity imparted to any portion of garment 11 will be grounded through fasteners 31 and cord 33.

Figure 3:
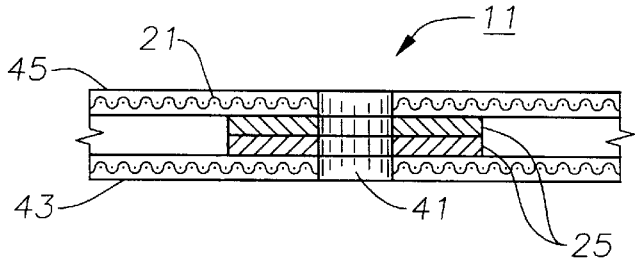
FIG. 3 is a sectional side view of the fastener portion of FIG. 2 at an initial stage of manufacture.
Figure 4:
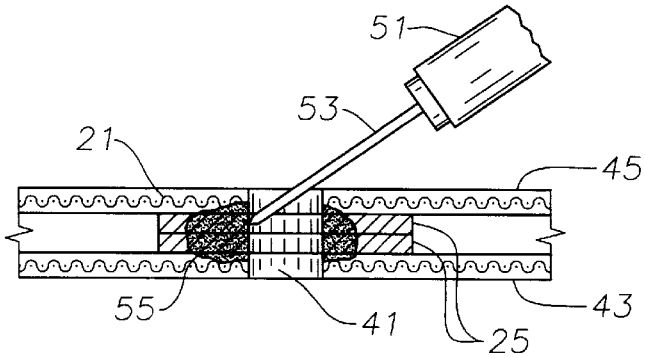
FIG. 4 is a sectional side view of the fastener portion of FIG. 2 at a second stage of manufacture.
Figure 5:
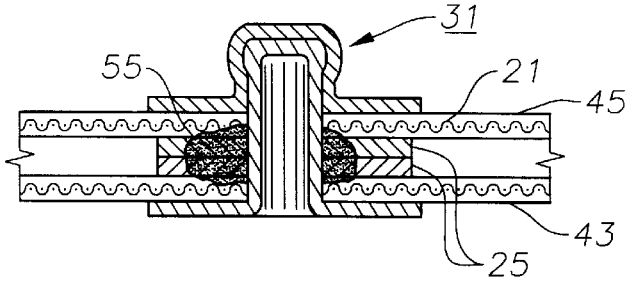
FIG. 5 is a sectional side view of the fastener portion of FIG. 2 after assembly and taken along the line 5—5 of FIG. 2.

Referring now to FIGS. 3 through 5, a process for extending the useful life of garment 11 at each fastener 31 is shown. FIG. 3 shows a fastener site after a hole 41 has been formed in the fabric, grids 21 and ribbons 25, but prior to the installation of fastener 31. In this embodiment, garment 11 has an inner layer 43 of fabric, an outer layer 45 of fabric and ribbons 25 sandwiched therebetween. After hole 41 is punched (FIG. 4), an epoxy applicator 51 having a syringe 53 injects a small amount of epoxy 55 around the inner surface of hole 41 so that it saturates into the surrounding fabric layers 43, 45, grids 21, and ribbons 25. Epoxy 55 contains silver or other electrically conductive components to enhance the conductivity of the joint at the fastener site. As shown in the embodiment of FIG. 5, fastener 31 is a two piece snap that is assembled through hole 41 to compress layers 43, 45 while epoxy 55 is still wet. After epoxy 55 cures, a flexible but resilient joint is formed between it and fastener 31, grids 21, and ribbons 25.

Figure 6:
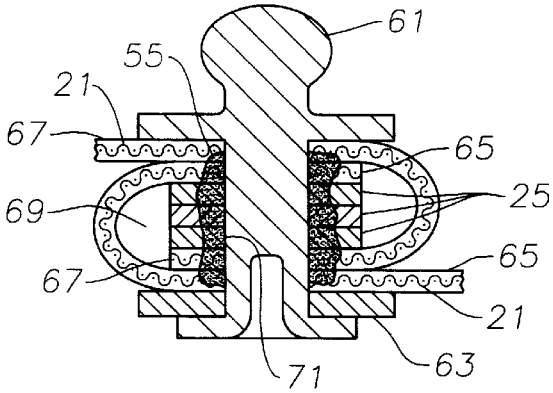
FIG. 6 is a sectional side view of an alternate embodiment of the fastener portion of FIG. 2.

Referring now to FIG. 6, a second embodiment of fastener 31 comprising a rivet-style snap 61 is shown. Snap 61 has a metal washer 63 for securing it in place. This version also illustrates a flat felled seam 19 having layers of overlapping fabric 65, 67. Both inner and outer layers 65, 67, respectively, curve back into contact with the other to form a pocket or channel 69 wherein a plurality of ribbons 25 are enclosed. With this configuration, the hole 71 through which snap 61 extends pierces each layer 65, 67 twice. As with the previous example, applicator 51 injects epoxy 55 into hole 67 to saturate the various materials and snap 61 is installed to form the joint.

Figure 7:
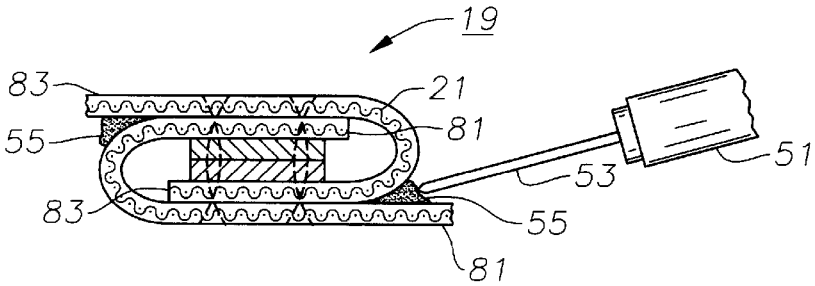
FIG. 7 is a sectional side view of a fabric seam on the garment of FIG. 1.

A final example is depicted in FIG. 7. Here, a sectional view of a seam 19 without a fastener 31 illustrates a double sewn, flat felled seam having inner and outer layers 81, 83. Ribbons 25 are located in a channel 85 formed between layers 81, 83. After assembly, applicator 51 injects epoxy 55 in a continuous bead at each interface between layers 81, 83 to saturate the materials. Alternatively, syringe 53 may be used to pierce directly into seam 19 and apply epoxy 55 at various intervals.

The invention has several advantages. The epoxy-reinforced fastener and seam joints of the invention greatly enhance the usable life of ESD garments by preventing breakage of the small, fragile conductors in the grids, and enhancing connectivity between the various components. Conductors in conventional garments typically experience electrical connectivity problems after just a few washes. In contrast, garments constructed with the epoxy reinforcements of this invention have durable connections even after 200 washes.

While the invention has been shown or described in only some of its forms, it should be apparent to those skilled in the art that it is not so limited, but is susceptible to various changes without departing from the scope of the invention.

What is claimed is:

1. An electrostatic discharge garment, comprising:

a fabric material having an electrically conductive element;

an electrical conductor mounted to the fabric material;

an aperture for electrically interconnecting the conductive element with the electrical conductor;

an electrically conductive epoxy disposed at the aperture for enhancing the durability of electrical connectivity at the aperture; and wherein the electrostatic discharge garment is an integral body suit having an abdominal portion, arm portions, and leg portions that are electrically interconnected via the electrically conductive element and the electrical conductor.

2. The garment of claim 1 wherein the epoxy contains silver.

3. An electrostatic discharge garment, comprising:

a fabric material having a plurality of flexible electric conductors;

a flat felled seam formed between portions of the fabric material;

an electrically conductive ribbon mounted to the fabric material;

an electrically conductive epoxy containing silver and located at an interface between the conductors, along the flat felled seam, and the ribbon for enhancing the durability of electrical connectivity at the interface; wherein the electrostatic discharge garment is an integral body suit having an abdominal portion, arm portions, and leg portions that are electrically interconnected via the conductors and the ribbon, and wherein each of the arm portions has a conductive cuff for contacting the skin of a user.

4. A method for making an ESD garment, comprising:

(a) providing a fabric having a grid of flexible electric conductors, forming a flat felled seam in the fabric, and extending an electrically conductive ribbon along the flat felled seam in electrical contact with the grid;

(b) injecting a wet, electrically conductive epoxy with a syringe at an interface between the grid of conductors, the flat felled seam, and the ribbon;

(c) curing the epoxy to form a flexible, resilient electrical joint at the interface; and (d) forming the material into an integral body suit having an abdominal portion, arm portions, and leg portions that are electrically interconnected via the grid of conductors and the ribbon.

5. The method of claim 4, further comprising the step of mixing silver in the epoxy.

* * * * *